US005236322A

United States Patent [19]

Willert

[11] Patent Number: 5,236,322

[45] Date of Patent: Aug. 17, 1993

[54] CAGE POSITIONER

[75] Inventor: Michael R. Willert, Nashua, Iowa

[73] Assignee: International Pipe Machinery Corporation, Sioux City, Iowa

[21] Appl. No.: 749,320

[22] Filed: Aug. 23, 1991

[51] Int. Cl.[5] ..... B28B 21/14; B28B 21/56

[52] U.S. Cl. ..... 425/117; 249/93; 264/275; 425/262

[58] Field of Search ..... 249/83, 91, 93, 94, 249/96, 97, 144; 425/110, 117, 256, 262, 427, 456, 424, 432; 264/275, 277, 278, 35

[56] References Cited

U.S. PATENT DOCUMENTS

| | | | |
|---|---|---|---|
| 2,181,958 | 12/1939 | Arborio | 249/91 |
| 2,287,858 | 6/1942 | Bespalow | 249/91 |
| 3,262,175 | 7/1966 | Gourlie et al. | 425/262 |
| 3,345,716 | 10/1967 | Uden | 249/144 |
| 3,687,597 | 8/1972 | Lavergne, Jr. | 425/438 |
| 3,957,409 | 5/1976 | Grosch | 425/171 |
| 4,151,246 | 3/1979 | Lester et al. | 264/297 |
| 4,505,658 | 3/1985 | Muller | 425/117 |
| 4,519,570 | 6/1985 | Strickland et al. | 249/194 |
| 4,610,422 | 5/1986 | Kraiss | 249/94 |
| 4,709,899 | 12/1987 | Kajioka et al. | 249/94 |
| 4,710,115 | 12/1987 | Tucker et al. | 425/117 |

FOREIGN PATENT DOCUMENTS 2010735 12/1978 United Kingdom .

*Primary Examiner*—Khanh P. Nguyen

*Attorney, Agent, or Firm*—Burd, Bartz & Gutenkauf

[57] ABSTRACT

A concrete pipe making machine having a vibrating core and counter-rotating roller head is used to form a concrete pipe within a form. A concrete pipe reinforcing cage located within the form is held in spaced relation relative thereto with a plurality of cage positioners. Each cage positioner has a moveable blade connected to a piston and cylinder assembly operable to move the blade to a cage holding position and a blade retracted position out of engagement with the cage. The piston and cylinder assembly has a cylinder with a internal chamber having a rectangular cross section. A rectangular piston within the chamber is secured directly to the blade.

28 Claims, 4 Drawing Sheets

CAGE POSITIONER

FIELD OF THE INVENTION

The invention relates to an apparatus for centering a pipe reinforcing cage within a form used with a concrete pipe making machine to make reinforced concrete pipe.

BACKGROUND OF THE INVENTION

Cylindrical wire cages are used to reinforce the walls of concrete pipes. The wire cages are placed within forms used with a packerhead concrete pipe making machines or vibrating core pipe making machines. Structures called cage positioners are used to locate the cages within the forms during the forming of the concrete pipe. The reinforcing cages must be centrally positioned in the forms so that they will be properly imbedded within the concrete to ensure uniform integrity of the pipe walls.

A cage positioner located within a reinforcing cage that moves upwardly with the packerhead to concentrically position the cage relative to the packerhead is disclosed by L. C. Gourlie et al in U.S. Pat. No. 3,262,275. A plurality of hydraulic piston and cylinder assemblies are mounted on the packerhead shaft. Shoes mounted on rods connected to the pistons slide upwardly along the cage during the forming of the pipe. W. Muller in U.S. Pat. No. 4,505,658 discloses a mechanism for centering a reinforcing cage within a form for making a concrete pipe with a packerhead concrete pipe making machine. The mechanism has a member which moves through a slot in the form and engages the cage to center the cage relative to the form. A spring biased over center mechanism retains the member in the cage engaging position. The centering members move away from the cage under the pressure of the concrete being formed into a pipe by the packerhead. Tucker et al in U.S. Pat. No. 4,710,115 discloses a cage positioning device mounted on the form to locate the concrete pipe reinforcing cage within the form. The device has a slide member guided with a frame mounted on the form for movement into engagement with the cage. The member moves through a slot in the side wall of the form. A piston and cylinder assembly mounted on the form operates a cam connected to the side member so that on operation of the piston and cylinder assembly, the slide member can be selectively moved into and out of engagement with the cage. These cage positioners have separate structures that must be adjustable to ensure the proper centering of the cage in the form. The adjusting structures and moving parts of the cage positioner increase costs and are subject to substantial wear and breakage when used with concrete pipe making machines and particularly with vibrating core pipe making machines.

SUMMARY OF THE INVENTION

The invention comprises an apparatus for positioning a concrete reinforcing cage centrally within a form used with a concrete pipe making machine to make concrete pipes. The apparatus is a cage positioner mounted directly on the form that effectively centralizes the cage within the form. A plurality of cage positioners are located at circumferentially spaced intervals around the form. Each cage positioner has a single moveable blade that resists wear and breakage and can be adjusted to accommodate different sized pipes and forms. The cage positioner is a strong, durable and economical structure that is usable with vibrating core concrete pipe making machines as it can withstand the vibrating forces that are generated in the operation of these machines. The cage positioner has a support mounted on side wall of the form. A moveable blade associated with the support moves through a slot in the form side wall and engages the cage to position the cage in spaced relation relative to the form. A piston and cylinder assembly operates to selectively move the blade to a cage holding position and a retracted position with the end of the blade aligned with the form. The piston and cylinder assembly has a cylinder mounted on the support and a piston movably located within the cylinder attached to the blade. Spacers located about the blade engage the piston to limit the stroke of the piston thereby adjust the cage holding position of the blade. This allows the cage positioner to be used with different sized forms and concrete pipes. Adjusting members are mounted on the cylinder to limit outward movement of the piston so that the cage positioner can be used with forms having different wall thicknesses.

A preferred embodiment of the cage positioner has a support mounted on the side wall of the form adjacent the generally upright slot in the form. A blade is moveable through the slot and engages the cage to position the cage in spaced relation relative to the form. A first guide mounted on the side wall adjacent the slot accommodates the blade. A second guide mounted on the support accommodates the blade so that the blade linearly moves relative to the first and second guides between the cage holding position and the blade retracted position. A piston and cylinder assembly mounted on the support selectively operates to move the blade between the cage holding position and the blade retracted position. The piston and cylinder assembly has a cylinder mounted on the support. The cylinder has an internal chamber having a rectangular cross sectional shape. A generally rectangular piston is movably located within the chamber. The blade is secured directly to the piston so that fluid under pressure directed to the chamber will move the piston and blade selectively between the cage holding position and the blade retracted position. The inward stroke of the piston is determined by stop members surrounding the blade and engageable with the piston. The number and size of the stop members can be changed so that different sized pipe and different wall thicknesses of the forms can be accommodated with the cage positioner. Adjusting members are mounted on the cylinder and extend into the chamber to limit the outward movement of the piston. This allows for the adjustment of the blade retracted position of the blade so that forms having different wall thicknesses can be used with the cage positioner.

DESCRIPTION OF THE PREFERRED EMBODIMENT

Figure 1:
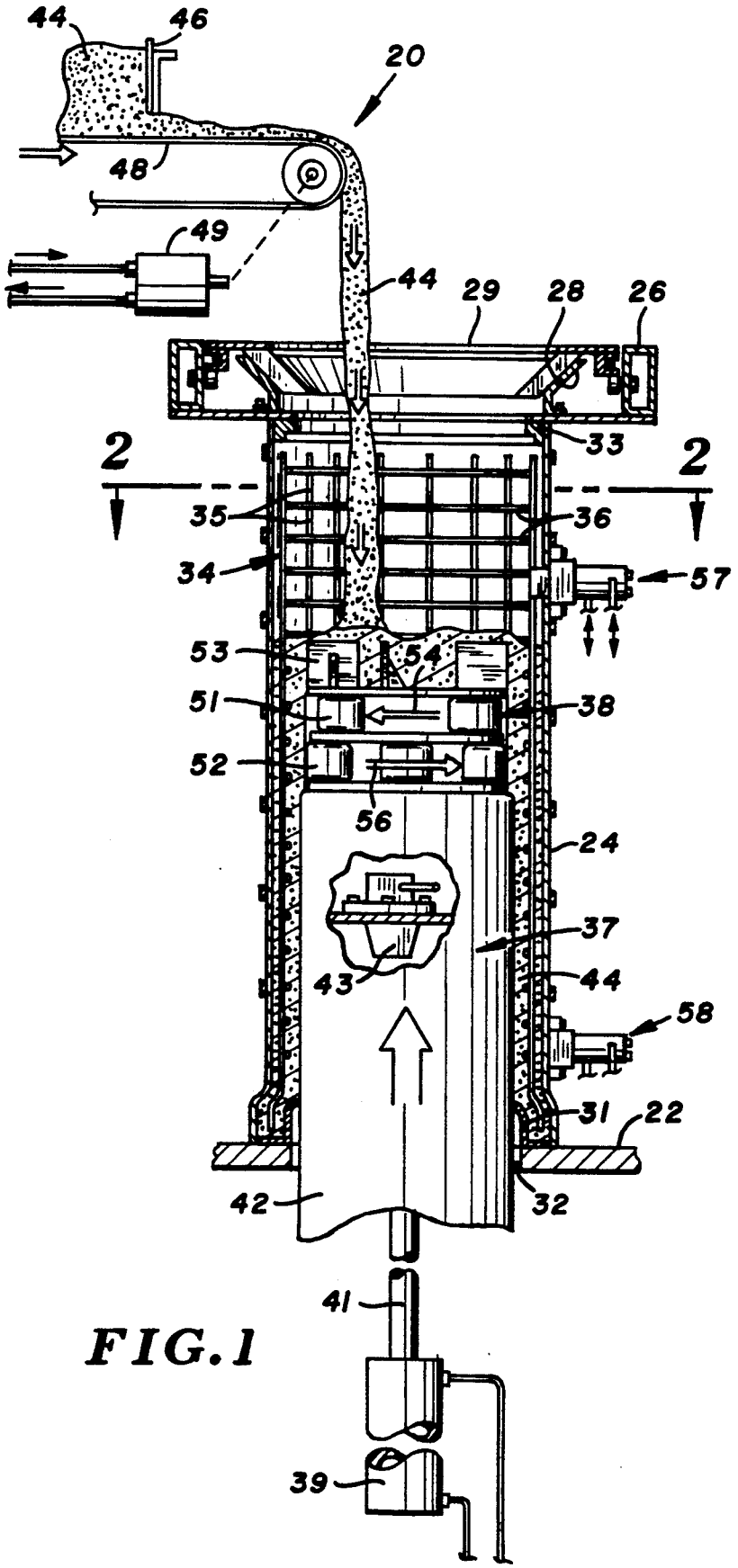
FIG. 1 is a diagrammatic view, partly sectioned, of a concrete pipe making machine having a core and packerhead movable into an upright form equipped with the cage positioners of the invention.

Referring to FIG. 1, there is shown a concrete pipe making machine indicated generally at 20 for making a reinforced cylindrical concrete pipe. An example of concrete pipe making machine 20 is disclosed by Mitchell and Fosse in U.S. Pat. No. 4,957,424. Examples of packerhead concrete pipe making machines are shown by Fosse in U.S. Pat. Nos. 4,340,553 and 4,407,648. These concrete pipe making machines accommodate upright cylindrical forms or molds 24, also known as jackets, for the concrete pipes. The form can have other shapes, such as square, hexagon, oval and the like. The concrete pipes made by these machines have cylindrical wire cages that reinforce the walls of the pipes. Cage positioners have been devised to hold the cages within the molds during the forming of the concrete pipes. Examples of cage positions are shown by Muller in U.S. Pat. No. 4,505,658 and Tucker et al in U.S. Pat. No. 4,710,115.

As shown in FIG. 1, form 24 is supported on a horizontal turntable 22. A top table 26 located over the top of form 24 has a concrete feeding device, as shown by Fosse et al in U.S. Pat. No. 3,551,968, that includes a downwardly directed funnel 28 and a scraper blade assembly 29 which is rotatable to move concrete into the open top of form 24. The bottom or bell end of form 24 surrounds a pallet 31 supported on turntable 22. Pallet 31 is located over an opening 32 in turntable 22 to allow core 42 to be moved up into form 24 to form a concrete pipe as hereinafter described. Top table 26 has an annular member 33 that fits into the top of form 24 to form the spigot end of the pipe.

The concrete pipe is reinforced with a generally cylindrical cage 34 comprising a plurality of circumferentially spaced vertical metal rods 35 secured to vertically spaced horizontal rods 36. Rods 35 and 36 are steel wires that are secured together to form the cylindrical cage. Rods 36 are circular and are secured by welds or the like to vertical rods 35.

Cage 34 is a single line reinforcement structure located in the mid-portion of the wall of the concrete pipe. Other types of cages, such as a double line, elliptical and triple reinforcement cage structures are used to reinforce concrete pipes.

Machine 20 has a cylindrical vibrating core indicated generally at 37 supporting a counter-rotating roller head 38. A piston and cylinder assembly 39 is connected with a piston rod 41 to core 37 to move core 37 up into form 24 and extract core 37 from form 24 after the pipe has been formed. Core 37 has a generally cylindrical sleeve 42 that supports a vibrator 43. An example of a vibrator for concrete pipe making machine 20 is shown by Fosse and Montgomery in U.S. Pat. No. 3,948,354. Vibrator 43 has a hydraulic motor which operates to generate vibration forces in the core. The concrete around core 37, cage 34, and mold 24 are all subjected to the vibration forces. These forces cause wear, loss of adjustment, and failure of the prior cage positioners.

A concrete feeding system delivers concrete 44 into the top of form 24 as core 37 and roller head 38 move up into form 24 to make the concrete pipe. The concrete 44 is moved from a hopper 46 with a conveyor 48. A hydraulic motor 49 operates the conveyor 48 to deliver a continuous stream of concrete to mold 24 above roller head 38. Roller head 38 has a plurality of upper rollers 51 and lower rollers 52 that are rotated in opposite directions as indicated by the arrows 54 and 56. The upper roller head has a plurality of upwardly directed paddles or fins 53 which work and move the concrete outwardly into the annular space between roller head 38 and inside wall 25 of mold 24. Roller head 38 packs the concrete around cage 34 to form the concrete pipe. Core 37 being vibrated by vibrator 43 vibrates core wall 42 to consolidate the concrete so that the pipe has substantially uniform density throughout the length thereof.

Figure 2:
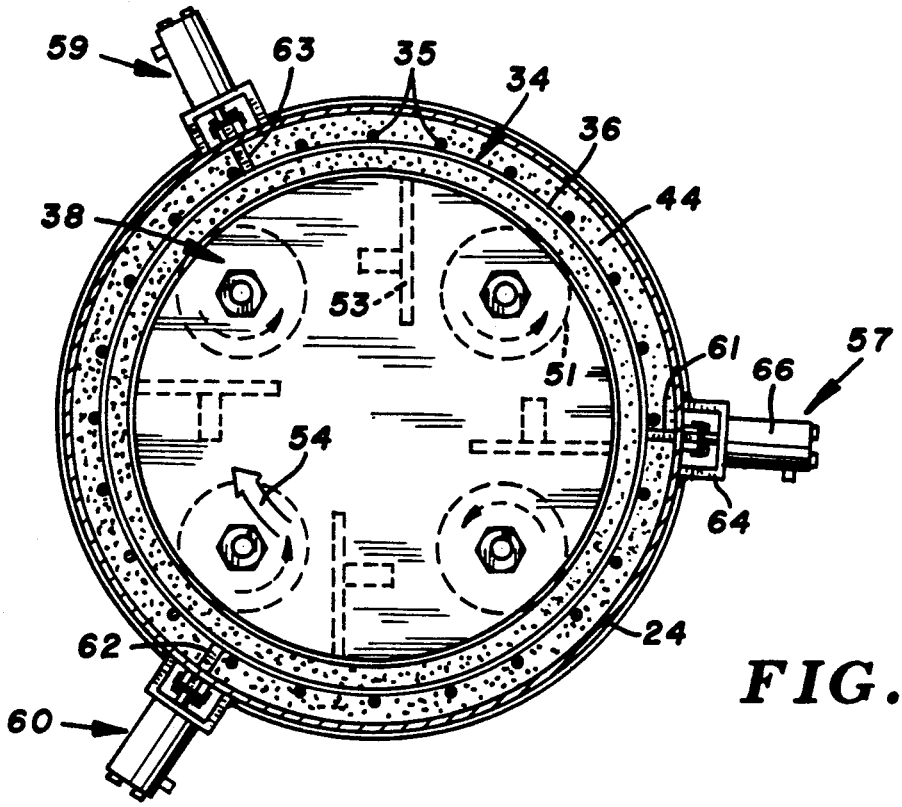
FIG. 2 is an enlarged sectional view taken along the line 2—2 of FIG. 1.

The cage 34 is positioned within form 24 with a plurality of cage positioners 57, 58, 59 and 60 of the invention circumferentially spaced around the form 24. Referring to FIG. 2, cage positioners 57, 59 and 60 are equally spaced from each other circumferentially around the upper section of form 24. Cage positioner 58 is located in the bottom section of form 24. Additional cage positioners are circumferentially spaced around the bottom of form 24. Cage positioners 57, 59 and 60 have generally flat vertical positioning blades 61, 62 and 63 that project through vertical openings or slots in the side wall of form 24 and engage one or more circumferential rods of cage 34 thereby locate the cage radially inwardly from form 24 to ensure that cage 34 is centrally located in the side wall of the concrete pipe.

Cage positioners 57–60 are identical in structure and operation. The following description is directed to cage positioner 57.

Figure 3:
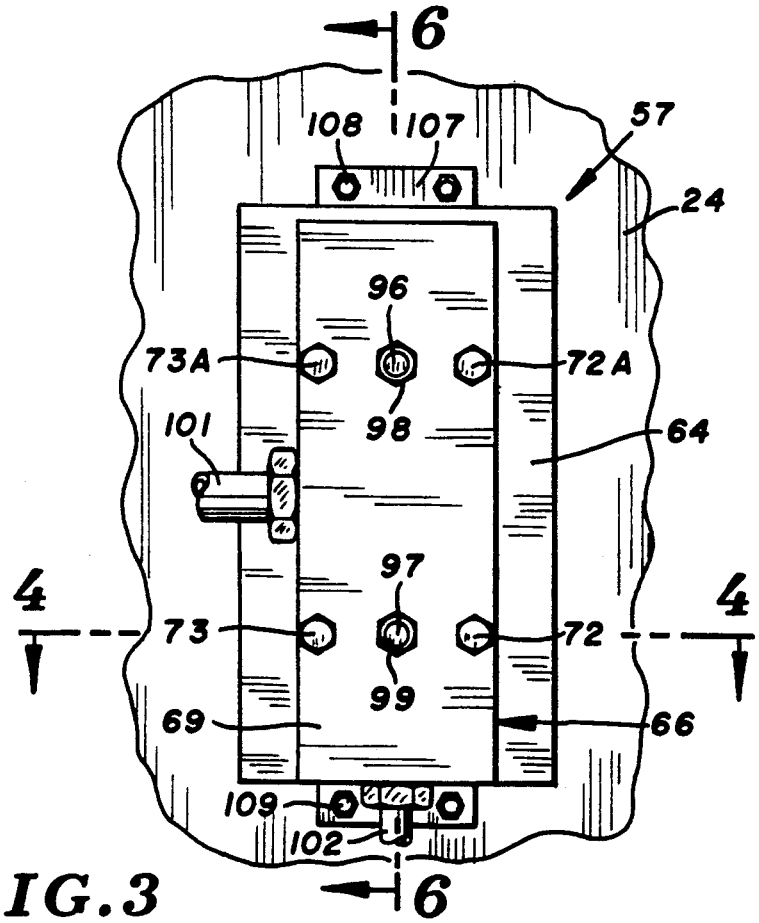
FIG. 3 is an enlarged end view of a cage positioner mounted on the form.
Figure 4:
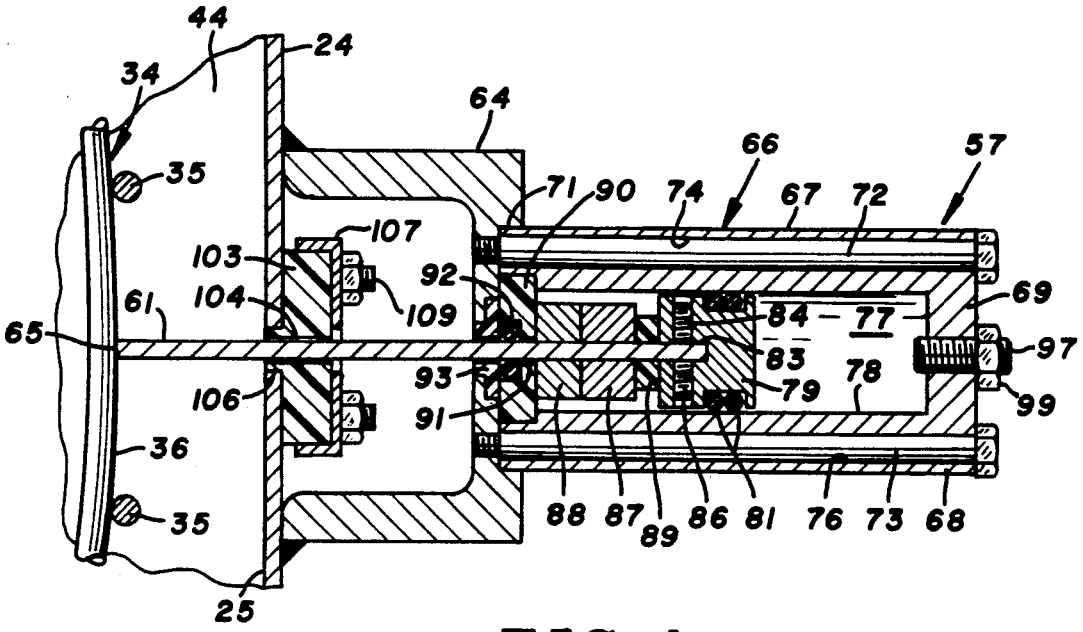
FIG. 4 is an enlarged sectional view taken along the line 4—4 of FIG. 3 showing the cage positioning blade in the cage holding position.
Figure 5:
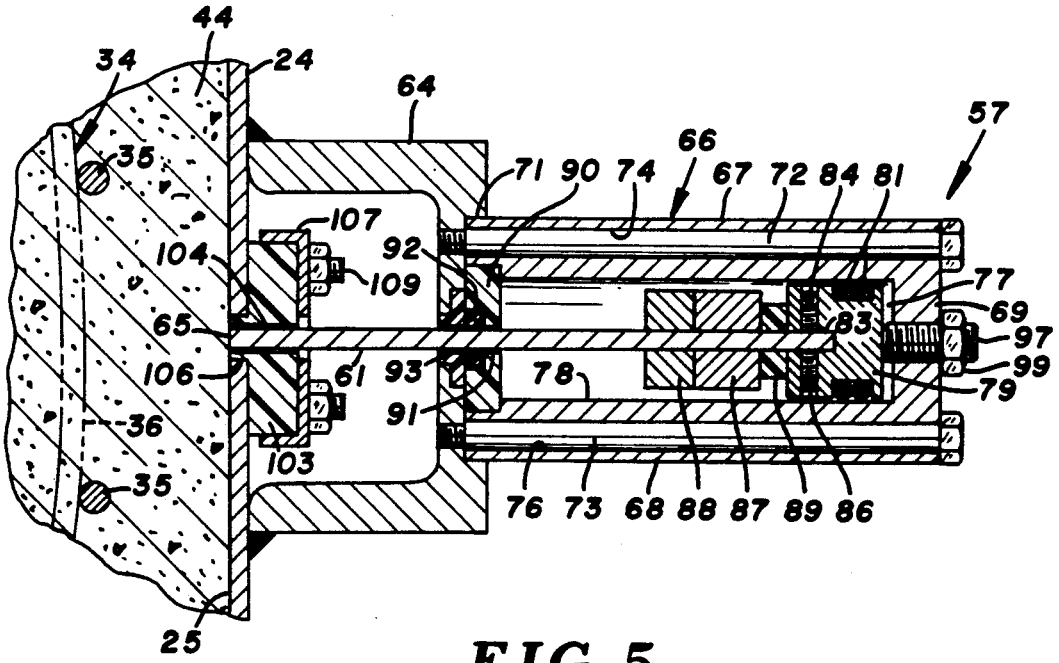
FIG. 5 is a sectional view similar to FIG. 4 showing the cage positioning blade in the blade retracted position.

As shown in FIGS. 3 and 4, cage positioner 57 has a channel support 64 secured by welds to the outside of form 24. Support 64 is a generally upright rectangular member having flanges secured to form 24 and a flat base laterally spaced from form 24. A double action air motor 66 is secured to support 64 with a plurality of bolts 72, 73, 72A and 73A. Motor 66 is a rectangular piston and cylinder assembly operable to control the position of positioning blade 61 between an extended position, shown in FIG. 4, and a retracted position, shown in FIG. 5. When blade 61 is in the extended position, the outer end 65 thereof engages rod 36 to space the cage 34 from the inside wall 25 of form 24. As shown in FIG. 5, when blade 61 is retracted, the outer end 65 is flush with the inside wall 25 of form 24.

Motor 66 has a pair of flat side walls 67 and 68 joined to a generally rectangular end wall 69. The side walls 67 and 68 fit into a recess 71 in support 64, as seen in FIG. 4. Bolts 72 and 73 extend through holes 74 and 76 in side walls 67 and 68 with the forward ends of the bolts 72 and 73 threaded into support 64. Bolts 72A and 73A extend through side walls 67 and 68 and into support 64 in an identical manner. Motor 66 has an internal chamber 77 having a generally rectangular inside wall 78. A rectangular piston 79 located in chamber 77 accommodates O-rings or seals 81 that are located in engagement with inside wall 78. The inside portion of piston 79 has a generally flat pocket or recess 83 that accommodates the positioning blade 61. Bolts 84, 84A and 86 threaded into piston 79 secure blade 61 to piston 79. A plurality of spacers 87, 88 and 89 surround blade 61 and engage piston 79 and an end wall or block 90 to limit the stroke of piston 79 and inward movement of blade 61 to retain cage 34 in a selected spaced relation relative to form 24. The number and thickness of spacers 87–89 can be changed to adjust the position of cage 34 within form 24. Block 90 has a generally rectangular slot 91 that allows blade 61 to project inwardly from motor 66. An O-ring 92 carried by block 90 engages a wear insert 93 having a generally rectangular opening for accommodating blade 61 to minimize the leakage of air under pressure from chamber 77. Block 90 is also a guide for blade 61 and maintains the transverse position of piston 79 in chamber 77.

Figure 6:
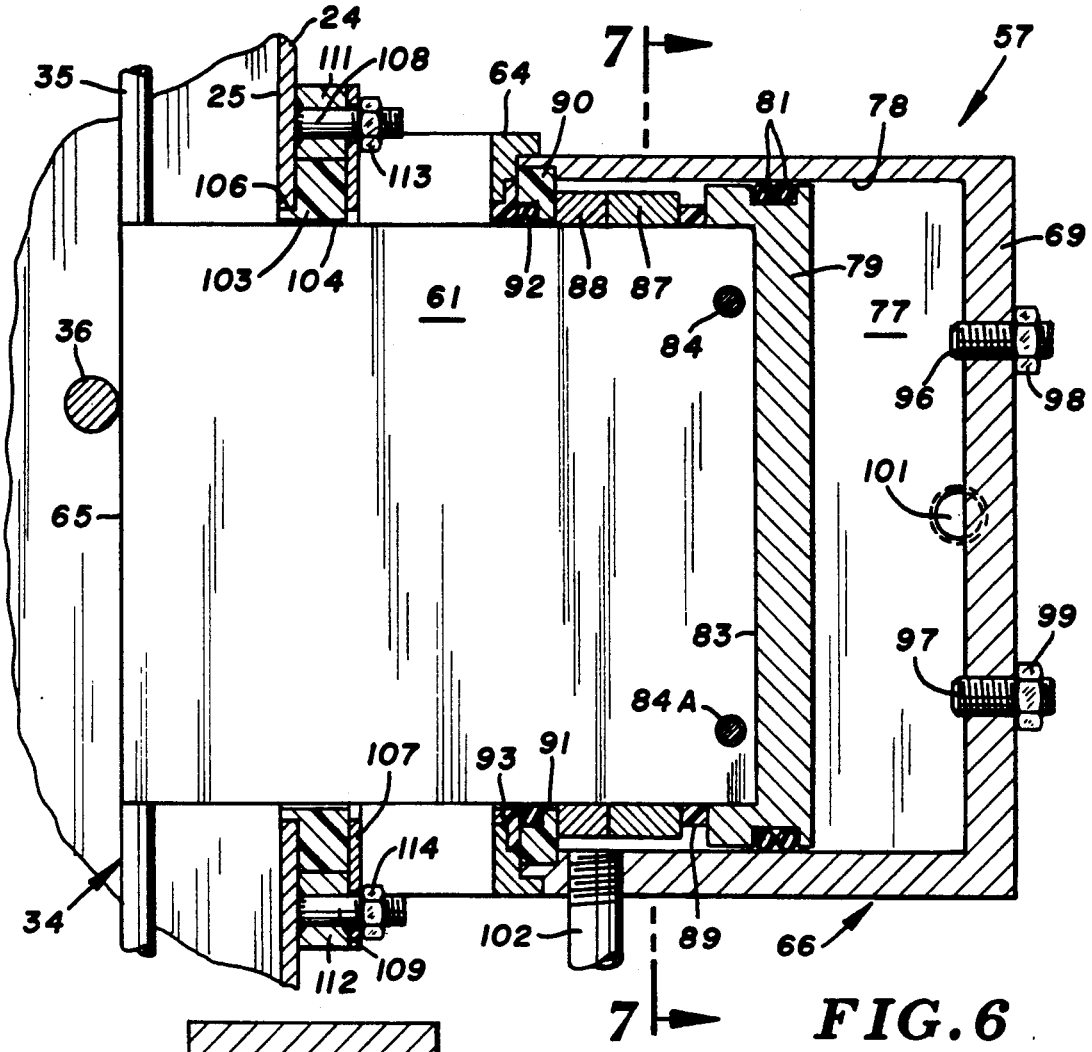
FIG. 6 is an enlarged sectional view taken along the line 6—6 of FIG. 3.
Figure 7:
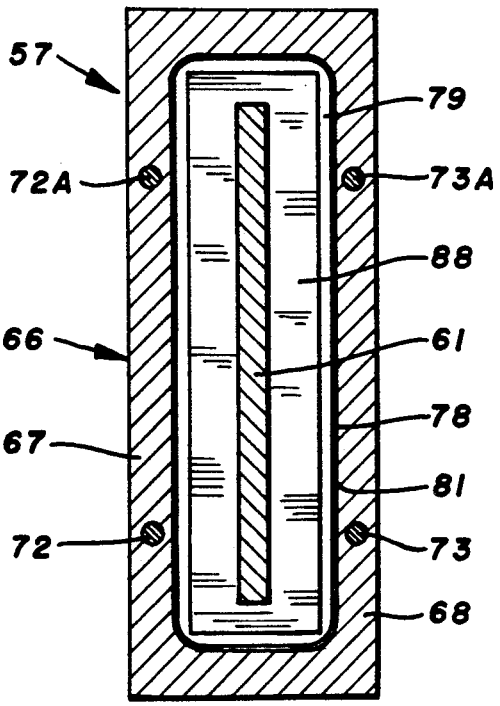
FIG. 7 is a sectional view taken along the line 7—7 of FIG. 6.

As seen in FIGS. 4, 5 and 6, the end wall 69 of motor 66 has a pair of adjustable stop bolts 96 and 97. Nuts 98 and 99 are threaded on the outer portions of bolts 96 and 97 to lock the bolts in selected adjusted positions. Blots 96 and 97 have inner ends that extend into chamber 77 thereby limit outward movement of piston 79 so that the outer end 65 of blade 66 can be located flush with the inside surface 25 of form 24 when it is in the extracted or out position as seen in FIG. 5. This adjustment allows the cage positioner to be used with forms having different wall thickness. Parts of the cage positioner are not changed to accommodate different forms.

Motor 66 has fluid passages 101 and 102 to allow fluid to flow into and out of opposite portions of chamber 77 on opposite sides of piston 79 thereby reciprocate piston 79 in chamber 77. Fluid under pressure, such as air or hydraulic fluid, derived from a fluid pressure source and controlled with a valve assembly (not shown) is used to provide fluid under pressure to motor 66 to selectively move the blade to its in or cage holding position and its extracted or out position.

Blade 61 moves through a guide bearing or block 103 having a generally rectangular slot 104 to accommodate blade 61. Blade 61 rides on bearing 103 and block 90 as it moves between the extended position shown in FIGS. 4 and 6 and the retracted position shown in FIG. 5. Since the blade 61 is secured with bolts 84, 84A and 86 to piston 79, the bearing 103 and block 90 through blade 61 guide piston 79 in chamber 77 as it moves in chamber 77. Bearing 103 fits into a generally rectangular slot 106 in form 24. A channel member 107 surrounds the outside of bearing 103 to hold the bearing on form 24. Opposite ends of channel member 107 are secured to studs 108 and 109 welded to form 24. Nuts 113 and 114 threaded onto studs 108 and 109 secure channel member 107 to form 24. Bosses or short spacer sleeves 111 and 112, as shown in FIG. 6, surround studs 108 and 109 to space channel member 107 from form 24. Nuts 113 and 114 can be removed from studs 108 and 109 thereby allowing the bearing 103 to be replaced.

In use, fluid under pressure is delivered to chamber 77 via passage 101 to move piston 79 and positioning blade 61 to the in position into engagement with cage 34 to position the cage in concentric spaced relation with form 24. The amount of inward movement of piston 79 is controlled by stops 87, 88 and 89 as seen in FIGS. 4 and 6. As the roller head 38 and core 37 move up into form 24 to form the concrete pipe, the lower cage positioners are initially operated to move blades 61 to their out or retracted positions as shown in FIG. 5. The upper cage positioners 57, 59 and 60, as seen in FIG. 3, remain in their in or holding positions, to ensure the centralization of cage 34 relative to form 24 as the concrete pipe is formed by roller head 38 and core 37. When roller head 38 reaches the level of the cage positioners 57, 59 and 60, pistons 79 along with blades 61 are retracted to the positions as shown in FIG. 5 to allow the concrete pipe to be completed without pockets or recesses in the outer surface thereof. When the concrete pipe is complete, core 37 and roller head 38 are moved downwardly through the concrete pipe below the turntable 22 by the action of cylinder 39. Turntable 22 moves the formed pipe to an off position. Form 24 is then stripped from the pipe with blades 61 in their retracted positions.

While there has been shown and described a preferred embodiment of the cage positioners for the form used with concrete pipe making machines for making concrete pipe it is understood that changes in the structure and arrangement of structures may be made by those skilled in the art without departing from the invention. The invention is defined in the following claims.

I claim:

1. An apparatus for positioning a concrete reinforcing cage in a hollow form having the cage positioned therein, said form having an upright side wall with a generally rectangular slot formed therein, comprising: a support mounted on the side wall adjacent said slot, a blade movable through said slot to an in position engageable with the cage to position the cage in spaced relation relative to said side wall of the form and movable to an out position away from the cage, first guide means mounted on the side wall adjacent the slot for accommodating said blade, second guide means mounted on the support for accommodating said blade, and piston and cylinder means mounted on the support having a moveable piston and a cylinder accommodating the piston for movement in the direction of movement of the blade, and means connecting the blade to the piston whereby the blade is supported by the piston and said first and second guide means for movement through said slot into engagement with the cage to hold the cage in spaced relation relative to the side wall and to retract the blade out of engagement with the cage.

2. The apparatus of claim 1 wherein: the first guide means includes a block having an opening aligned with the slot accommodating the blade, and means securing the block to the side wall of the form.

3. The apparatus of claim 1 wherein: the second guide means includes a block having an opening aligned with the slot accommodating the blade.

4. The apparatus of claim 1 wherein: the first guide means includes a first block having a first opening aligned with the slot, said second guide means includes a second block having a second opening aligned with the first opening, said first and second blocks guiding the blade for movement through said slot to a cage holding position and a retracted position relative to said cage.

5. The apparatus of claim 1 including: means for directing fluid under pressure to said cylinder to move the piston and blade selectively between the cage holding the position and blade retracted position.

6. The apparatus of claim 1 including: first stop means cooperating with the piston for determining the cage holding position of the blade, and second stop means mounted on the cylinder cooperating with the piston for limiting the retracted position of the blade.

7. The apparatus of claim 1 wherein: said cylinder has an internal chamber aligned with the path of movement of the blade, said piston located within the chamber whereby fluid under pressure in said chamber moves said piston and blade selectively between the cage holding position and blade retracted position.

8. The apparatus of claim 7 wherein: the internal chamber of the cylinder has a generally rectangular cross sectional shape, said piston having a rectangular shape corresponding to the rectangular shape of the internal chamber of the cylinder.

9. The apparatus of claim 7 including: first stop means cooperating with the piston for determining the cage holding position of the blade, and second stop means cooperating with the piston for limiting the retracted position of the blade.

10. An apparatus for positioning a concrete reinforcing cage in a hollow form having the cage positioned therein, said form having an upright side wall with a generally rectangular slot form therein, comprising: a support mounted on the side wall adjacent said slot, a blade movable through said slot and engageable with the cage to position the cage in spaced relation to said side wall of the form, first guide means mounted on the side wall adjacent the slot for accommodating said blade, second guide means mounted on the support for accommodating said blade, means mounted on the support having a movable member connected to the blade operable to move the blade relative to the first and second guide means through said slot into engagement with the cage to hold the cage in spaced relation relative to the side wall and to retract the blade out of engagement with the cage, said first guide means includes a first block having a first opening aligned with the slot, said second guide means includes a second block having a second opening aligned with the first opening, said first and second blocks guiding the blade for movement through said slot to a cage holding position and a retracted position relative to said cage, said means mounted on the support includes a cylinder having an internal chamber mounted on the support, said movable member comprising a piston located within the chamber of the cylinder, means connecting the blade to the piston, means for directing fluid under pressure to said chamber to move the piston and blade selectively between the cage holding position and blade retracted position, first stop means cooperating with the piston for determining the cage holding position of the blade, and second stop means cooperating with the piston for limiting the retracted position of the blade, the first stop means includes spacer means surrounding the blade adjacent the piston for determining the cage holding position of the blade.

11. The apparatus of claim 10 wherein: the spacer means includes a plurality of spacing members mounted on the blade, the number and width of the spacing members being adjustable to adjust the cage holding position of the blade.

12. The apparatus of claim 10 wherein: the second stop means includes adjustable means mounted on the cylinder, said piston being engageable with the adjustable means to determine the retracted position of the blade.

13. The apparatus of claim 10 wherein: the cylinder has an internal chamber having a generally rectangular cross sectional shape, said piston having a rectangular shape corresponding to the rectangular shape of the internal chamber of the cylinder.

14. An apparatus for positioning a concrete reinforcing cage in a hollow form having the cage positioned therein, said form having an upright side wall with a generally rectangular slot form therein, comprising: a support mounted on the side wall adjacent said slot, a blade movable through said slot and engageable with the cage to position the cage in spaced relation relative to said side wall of the form, first guide means mounted on the side wall adjacent the slot for accommodating said blade, second guide means mounted on the support for accommodating said blade, means mounted on the support having a movable member connected to the blade operable to move the blade relative to said first and second guide means through said slot into engagement with the cage to hold the cage in spaced relation relative to the side wall and to retract the blade out of engagement with the cage, said means mounted on the support for moving the blade comprises a piston and cylinder assembly having a cylinder mounted on the support, said cylinder having an internal chamber aligned with the path of movement of the blade, a piston located within the chamber, means connecting the piston to the blade whereby fluid under pressure in said chamber moves said piston and blade selectively between the cage holding position and blade retracted position, first stop means cooperating with the piston for determining the cage holding position of the blade, second stop means cooperating with the piston for limiting the retracted position of the blade, and the first stop means includes spacer means surrounding the blade adjacent the piston for determining the cage holding position of the blade.

15. The apparatus of claim 14 wherein: the spacer means includes a plurality of spacing members mounted on the blade, the number and width of the spacing members being adjustable to adjust the cape holding position of the blade.

16. An apparatus for positioning a concrete reinforcing cage in a hollow form having the cage positioned therein, said form having an upright side wall with a generally rectangular slot form therein, comprising: a support mounted on the side wall adjacent said slot, a blade movable through said slot and engageable with the cage to position the cage in spaced relation relative to said side wall of the form, first guide means mounted on the side wall adjacent the slot for accommodating said blade, second guide means mounted on the support for accommodating said blade, means mounted on the support having a movable member connected to the blade operable to move the blade relative to said first and second guide means through said slot into engagement with the cage to hold the cage in spaced relation relative to the side wall and to retract the blade out of engagement with the cage, said means mounted on the support for moving the blade comprises a piston and cylinder assembly having a cylinder mounted on the support, said cylinder having an internal chamber aligned with the path of movement of the blade, a piston located within the chamber, means connecting the piston to the blade whereby fluid under pressure in said chamber moves said piston and blade selectively between the cage holding position and blade retracted position, first stop means cooperating with the piston for determining the cage holding position of the blade, second stop means cooperating with the piston for limiting the retracted position of the blade, and the second stop means includes adjustable means mounted on the cylinder, said piston being engageable with the adjustable means to determine the retracted position of the blade.

17. The apparatus of claim 16 wherein: the internal chamber of the cylinder has a generally rectangular cross sectional shape, said piston having a rectangular shape corresponding to the rectangular shape of the internal chamber of the cylinder.

18. An apparatus for positioning a concrete reinforcing cage in a hollow mold having the cage position therein, sad mold having an upright side wall with a generally rectangular slot form therein, comprising: a support mounted on the side wall adjacent said slot, blade means movable through said slot and engageable with the cage to position the cage and spaced relation relative to the side wall of the mold, means supporting the blade means on the support for movement to a cage holding position and a retracted position out of engagement with the cage, and a piston and cylinder assembly operable to move said blade means to the cage holding position and the retracted position, said piston and cylinder assembly comprising a cylinder mounted on the support, said cylinder having an internal chamber adapted to accommodate fluid under pressure, and a piston movably located within said internal chamber, means connecting the piston to the blade means whereby a fluid under pressure in said chamber moves said piston and blade means selectively between the cage holding position and blade retracting position, first stop means cooperating with the piston for determining the cage holding position of the blade means, and second stop means cooperating with the piston for limiting the retracted position of the blade means, said second stop means includes adjustable means mounted on the cylinder, said piston being engageable with the adjustable means to determine the retracted position of the blade means.

19. The apparatus of claim 18 wherein: the internal chamber of the cylinder has a generally rectangular cross sectional shape, said piston having a rectangular shape corresponding to the rectangular shape to the internal chamber of the cylinder.

20. The apparatus of claim 18 wherein: the internal chamber of the cylinder extends in the direction of the path of movement of the blade means, said blade means extended into said internal chamber, said piston being mounted on said blade means.

21. An apparatus for positioning a concrete reinforcing cage in a hollow mold having the cage position therein, said mold having an upright side wall with a generally rectangular slot form therein, comprising: a support mounted on the side wall adjacent said slot, blade means movable through said slot and engageable with the cage to position the cage and spaced relation relative to the side wall of the mold, means supporting the blade means on the support for movement to a cage holding position and a retracted position out of engagement with the cage, and a piston and cylinder assembly operable to move said blade means to the cage holding position and the retracted position, said piston and cylinder assembly comprising a cylinder mounted on the support, said cylinder having an internal chamber adapted to accommodate fluid under pressure, and a piston movably located within said internal chamber, means connecting the piston to the blade means whereby a fluid under pressure in said chamber moves said piston and blade means selectively between the cage holding position and blade retracting position, first stop means cooperating with the piston for determining the cage holding position of the blade means, and second stop means cooperating with the piston for limiting the retracted position of the blade means, the first stop means includes spacer means surrounding the blade means adjacent a piston for determining the cage holding position of the blade.

22. The apparatus of claim 21 wherein: the spacer means includes a plurality of spacing members mounted on the blade means, the number and width of the spacing members being adjustable to adjust the cage holding position of the blade means.

23. An apparatus of centering a reinforcing cage in a mold for the manufacture of reinforced concrete pipe comprising: a plurality of cage positioning assemblies spaced around said mold, each of said cage positioning assemblies having a support mounted on the mold adjacent a slot in said mold, a blade moveable through said slot and engageable with the cage to position the cage and spaced relation relative to said mold, guide means mounted on the side wall adjacent the slot for accommodating said blade, means mounted on the support having a moveable member connected to the blade operable to move the blade relative to the guide means through said slot into engagement with the cage to hold the cage and spaced relation relative to the mold and retract the blade out of engagement with the cage, said means mounted on the support includes a cylinder having internal chamber mounted on the support, said moveable member comprising a piston located with the chamber of the cylinder, means connecting the blade to the piston whereby fluid under pressure supplied to said chamber moves said piston and blade selectively between the cage holding position and the blade retracted position, first stop means cooperating with the piston for determining the cage holding position of the blade, and second stop means cooperating with the piston for limiting the retracted position of the blade, the first stop means includes spacer means surrounding the blade adjacent the piston for determining the cage holding position of the blade.

24. The apparatus of claim 23 wherein: the spacer means includes a plurality of spacing members mounted on the blade, the number and the width of the spacing members being adjustable to adjust the cage holding position of the blade.

25. An apparatus of centering a reinforcing cage in a mold for the manufacture of reinforced concrete pipe comprising: a plurality of cage positioning assemblies spaced around said mold, each of said cage positioning assemblies having a support mounted on the mold adjacent a slot in said mold, a blade moveable through said slot and engageable with the cage to position the cage and spaced relation relative to said mold, guide means mounted on the side wall adjacent the slot for accommodating said blade, means mounted on the support having a moveable member connected to the blade operable to move the blade relative to the guide means through said slot into engagement with the cage to hold the cage and spaced relation relative to the mold and retract the blade out of engagement with the cage, said means mounted on the support includes a cylinder having internal chamber mounted on the support, said moveable member comprising a piston located with the chamber of the cylinder, means connecting the blade to the piston whereby fluid under pressure supplied to said chamber moves said piston and blade selectively between the cage holding position and the blade retracted position, first stop means cooperating with the piston for determining the cage holding position of the blade, and second stop means cooperating with the piston for limiting the retracted position of the blade, the second stop means includes adjustable means mounted on the cylinder, said piston being engageable with the adjustable means to determine a retracted position of the blade.

26. The apparatus of claim 25 wherein: the internal chamber of the cylinder has a generally rectangular cross sectional shape, said piston having a rectangular shape corresponding to the rectangular shape of the internal chamber of the cylinder.

27. An apparatus for centering a reinforcing cage in a mold for the manufacturing of concrete pipe, said apparatus comprising a slot formed in the mold, a support mounted on the mold adjacent the slot, a blade moveable through said slot and engageable with the cage to position said cage in spaced relation to the mold, guide means mounted on the mold for accommodating the blade, a piston-cylinder unit mounted on the support for extending the blade relative to the guide means through said slot into engagement with the cage and for retracting the blade out of engagement with cage, said piston-cylinder unit includes a cylinder having an internal chamber and a piston reciprocating therein, a first stop means determining the cage engaging position of the blade, and a second stop means limiting the retracted position of the blade, said second stop means includes adjustable means mounted on the cylinder and engageable with the piston to determine the retracted position of the blade, and the first stop means includes spacer means surrounding the blade and located between the piston and support member for spacing said piston from said support member.

28. The apparatus of claim 27 wherein: the internal chamber of the cylinder has a generally rectangular cross sectional shape, said piston having a rectangular shape, said piston having a rectangular shape corresponding to the rectangular shape of the internal chamber of the cylinder.

* * * * *